United States Patent [19]

Jacobson

[11] 4,253,235

[45] Mar. 3, 1981

[54] SHAVING SYSTEM

[75] Inventor: Chester F. Jacobson, Southboro, Mass.

[73] Assignee: The Gillette Company, Boston, Mass.

[21] Appl. No.: 49,923

[22] Filed: Jun. 19, 1979

[51] Int. Cl.[3] ..... B26B 21/14

[52] U.S. Cl. ..... 30/47; 30/87

[58] Field of Search ..... 30/47, 50, 51, 57, 87, 30/88, 89, 346.58

[56] References Cited

U.S. PATENT DOCUMENTS

| | | | |
|---|---|---|---|
| 996,879 | 7/1911 | Odell | 30/87 X |
| 1,441,016 | 1/1923 | Matthews | 30/89 X |
| 1,675,128 | 6/1928 | Ostrovsky | 30/89 X |
| 1,771,235 | 7/1930 | Salerni | 30/57 |
| 2,386,536 | 10/1945 | Bensel | 30/47 |
| 3,593,416 | 7/1971 | Edson | 30/57 X |
| 3,975,820 | 8/1976 | Torance | 30/47 |
| 4,026,016 | 5/1977 | Nissen | 30/47 |
| 4,057,896 | 11/1977 | Trotta | 30/89 |
| 4,083,104 | 4/1978 | Nissen | 30/47 |
| 4,094,063 | 6/1978 | Trotta | 30/47 |

FOREIGN PATENT DOCUMENTS

| | | | |
|---|---|---|---|
| 95521 | 4/1924 | Austria | 30/89 |
| 1460732 | 1/1977 | United Kingdom . | |

*Primary Examiner*—Gary L. Smith

*Attorney, Agent, or Firm*—Richard A. Wise; Scott R. Foster

[57] ABSTRACT

A shaving system including a razor handle and a replaceable blade assembly, the handle having first and second arms with first and second journals thereon, the arms being movable away from each other in such manner as to cause the journals to move away from each other along a common axis, a spring for biasing the arms toward each other, and a cam disposed on each of the arms, and a blade assembly including a housing having first and second journal bearings for receiving the first and second journals for pivotal mounting of the blade assembly on the handle, and cam surfaces for complemental engagement with the handle cams, the cam surfaces and handle cams cooperating to urge the blade assembly to a neutral position.

8 Claims, 6 Drawing Figures

SHAVING SYSTEM

BACKGROUND OF THE INVENTION

1. Field of the Invention

This invention relates to wet shaving systems, and is directed more particularly to such a system in which a blade assembly is pivotally mounted on a handle.

2. Description of the Prior Art

In U.S. Pat. No. 4,083,104, issued Apr. 11, 1978 to Warren I. Nissen, et al, there is disclosed a razor adapted to pivotally retain a blade assembly. In the preferred embodiment, razor arms having journals thereon are pivotally movable to release or capture a blade assembly. In addition, the razor is provided with a spring biased plunger extending from the head of the razor and engaging a cam surface on the underside of the cartridge to bias the pivotally mounted cartridge toward a neutral position. In U.S. Pat. No. 4,026,016, issued May 31, 1977 to Warren I. Nissen, there is disclosed a blade assembly for use with the handle, the blade assembly having journal bearings for receiving the handle journals, as well as the above mentioned cam surface for receiving a biasing force exerted by the handle plunger.

While the shaving system shown and described in the above cited patents has found widespread acceptance, it is thought disadvantageous in many instances that the pivotal movement of the handle arms tend to release the blade assembly in such a manner as to sometimes hurl the blade assembly outwardly from the handle. In addition, the spring biased plunger exercises a degree of outward thrust on the blade assembly, so that once released the blade assembly is further urged outwardly from the razor handle. It is deemed preferable that the advantages of such a system be retained, but with a blade assembly release means and blade assembly positioning means not conducive to forcing movement of a released blade assembly.

SUMMARY OF THE INVENTION

It is therefore, an object of the present invention to provide a shaving system having the advantages of the above described shaving system but including a handle having an improved blade assembly release mechanism.

A still further object of the invention is to provide such a system including a blade assembly having means for cooperating with the mounting means and blade assembly positioning means of the handle.

With the above and other objects in view, as will hereinafter appear, a feature of the present invention is the provision of a shaving system comprising a razor handle and a replaceable blade assembly, the handle comprising a grip portion and a head portion, the head portion having first and second arms extending therefrom, first and second journals disposed respectively on the first and second arms, the journals extending inwardly toward each other and in axial alignment with each other to define an axis transverse to the grip portion, button means disposed on the head portion, and means interconnecting the button means and the arms whereby manual manipulation of the button means is operative to move the arms apart from each other in such manner as to cause the journals to move away from each other along the above mentioned axis, spring means biasing the arms toward each other, and cam means disposed on each of the arms, the cam means extending inwardly of the arms toward each other, and a blade assembly comprising a housing, blade means fixed to the housing, first and second journal bearings disposed in the housing for receiving respectively the first and second journals for pivotal mounting of the blade assembly on the handle, and cam means disposed in the housing for complemental engagement with the handle cam means, the blade assembly cam means and the handle cam means cooperating to urge the blade assembly to a neutral position.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention from which its novel features and advantages will be apparent.

In the drawings.

DESCRIPTION OF THE PREFERRED EMBODIMENT

Figure 1:
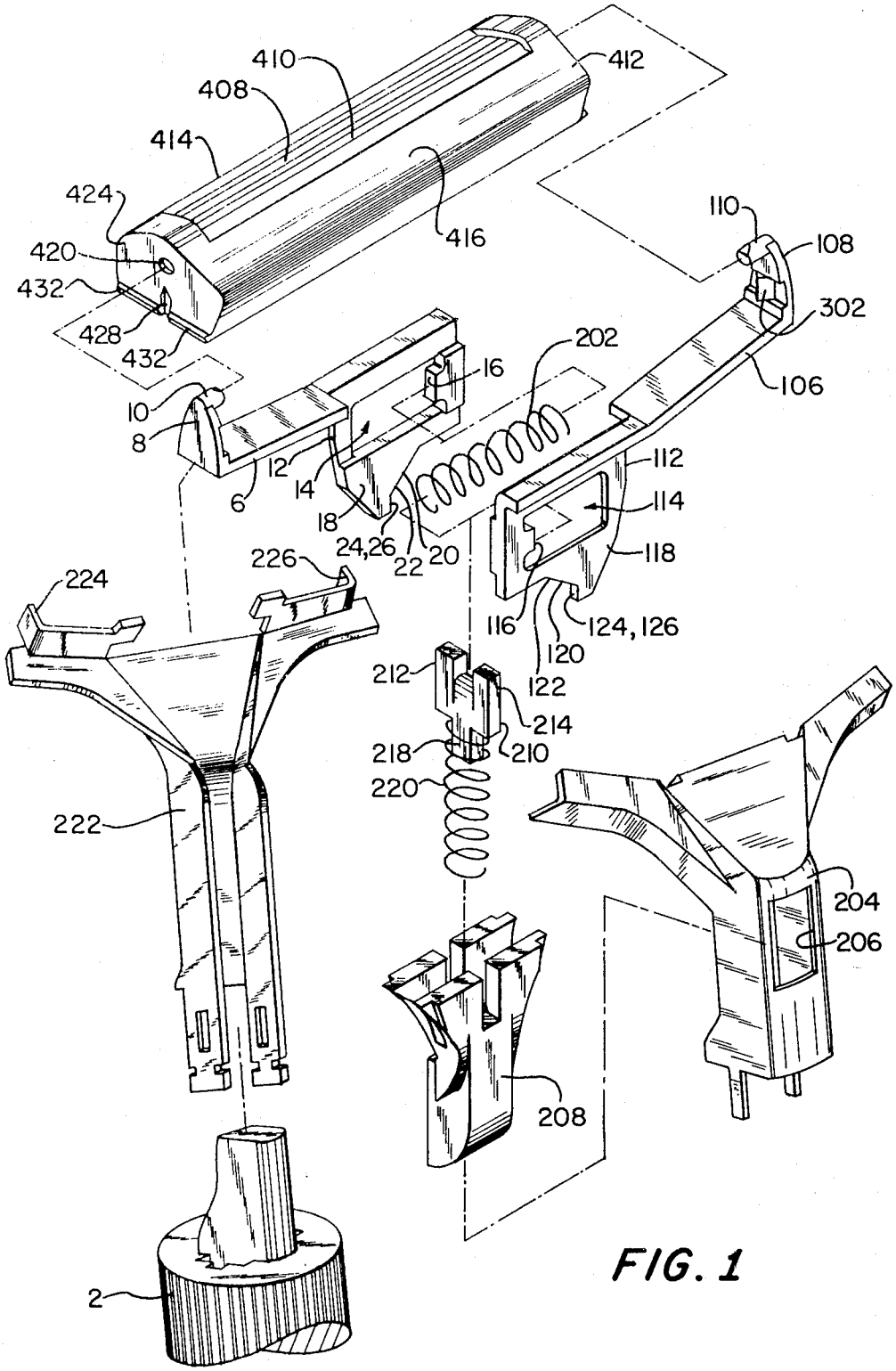
FIG. 1 is a perspective exploded view of one form of razor handle illustrative of an embodiment of the invention.

Referring to the drawings, it will be seen that the razor includes a grip portion 2 and a head portion 4. The head portion 4 includes a first arm 6 having an upstanding end portion 8. A first pivot mounting means, preferably a journal 10 is fixed to the first arm end portion 8. Affixed to the first arm 6 is a first frame member 12 having an opening 14 therein. A first protrusion 16 extends inwardly of the opening 14 from a side of the first frame member 12. Extending downwardly from a bottom portion of the first frame member 12, as viewed in the drawings, is a first extension 18 having an inclined edge 20 forming a first cam surface 22, and an edge surface 24 defining a first channel wall 26, which will be further described below.

The head portion 4 further includes a second arm 106 having an upstanding end portion 108. A second pivot mounting means, preferably a journal 110 is fixed to the second arm end portion 108. Affixed to the second arm 106 is a second frame member 112 having an opening 114 therein, the opening 114 being generally in alignment with the first opening 14. A second protrusion 116 extends inwardly of the opening 114 from a side of the second frame member 112, the second protrusion 116 being generally opposed to the first protrusion 16. Extending downwardly from a bottom portion of the second frame member 112, as viewed in the drawings, is a second extension 118 having an inclined edge 120 forming a second cam surface 122, and an edge surface 124 defining a second channel wall 126, the first and second channel walls 26, 126 defining a channel 200 therebetween, the channel 200 leading to an intersection of the opposed first and second cam surfaces 22, 122.

Figure 2:
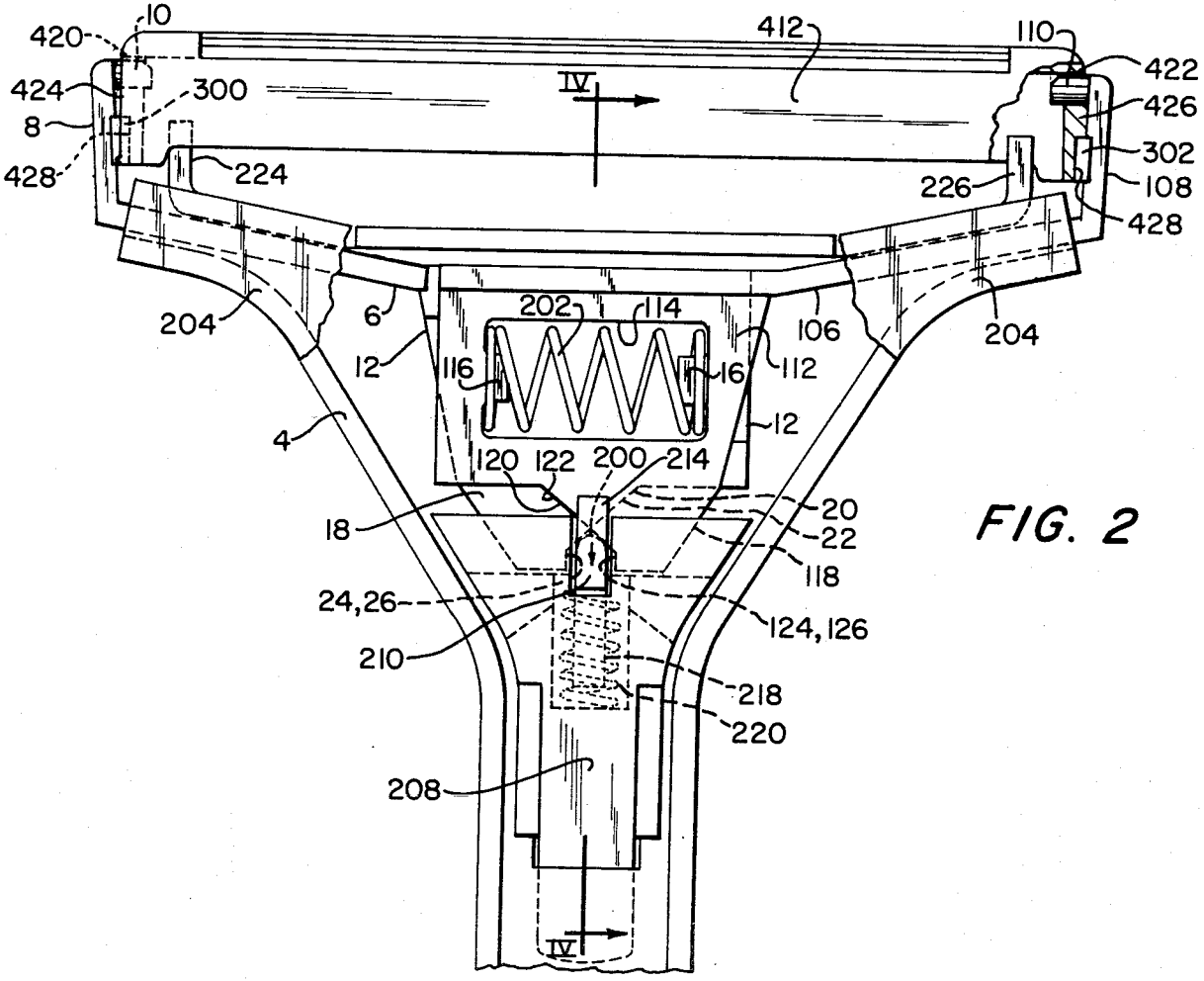
FIG. 2 is a rear elevational view, broken away for clarity, the handle being shown with its arms in the blade assembly retaining position.

A coil spring 202 is disposed in the openings 14, 114, fitted over the protrusions 16, 116. The spring 202 operates to urge the frame members 12, 112 to stay in substantial alignment with each other and biases the frame members 12, 112 toward the position shown in FIG. 2.

The head portion 4 includes a first housing member 204 having an opening 206 therein. Extending through the opening 206 is a push button 208 in which is mounted a bifurcated actuator 210 having upstanding lugs 212, 214 defining a recess 216 therebetween. The actuator 210 includes a stem portion 218 about which there is disposed a coil spring 220. The actuator 210 engages the opposed first and second cam surfaces 22, 122 by way of the channel 200, the lug 212 being on one side of the extensions 18, 118 and the lug 214 being on the other. The coil spring 220 maintains the actuator 210 in engagement with the cam surfaces 22, 122.

The head portion 4 further includes a second housing member 222, which along with the first housing member 204, inclose the above described mechanism. The second housing member 222 includes a pair of upstanding detents 224, 226 which are disposed proximate to the arm end portions 8, 108, respectively.

In operation, the journals 10, 110 must be moved outwardly from each other to accept a shaving unit therebetween. The shaving unit (described hereinbelow) is provided with journal bearings which accept the journals 10, 110 for pivotally mounting the shaving unit on the razor. To separate the journals 10, 110 an operator depresses the push button 208, urging the actuator forcefully against the cam surfaces 22, 122, causing the frame members 12, 112 to slide in opposite directions along the axis of the coil spring 202, compressing the spring 202. The arm end portions are then positioned to bring the journals 10, 110 into register with the aforementioned journal bearings. Upon release of the button 208, the coil spring 202 causes the frame members 12, 112 to snap back into alignment and the opposed journals 10, 110 to move along their axes toward one another to engage the shaving unit.

To release the shaving unit, the operation is repeated, the journals 10, 110 being thereby caused to move outwardly along their aligned axes to separate from the shaving unit and thereby release the shaving unit from the razor.

The upstanding detents 224, 226 are operative to prevent accidental endwise movement of the shaving unit which might cause separation of the journals and inadvertant release of the shaving unit.

Figure 5:
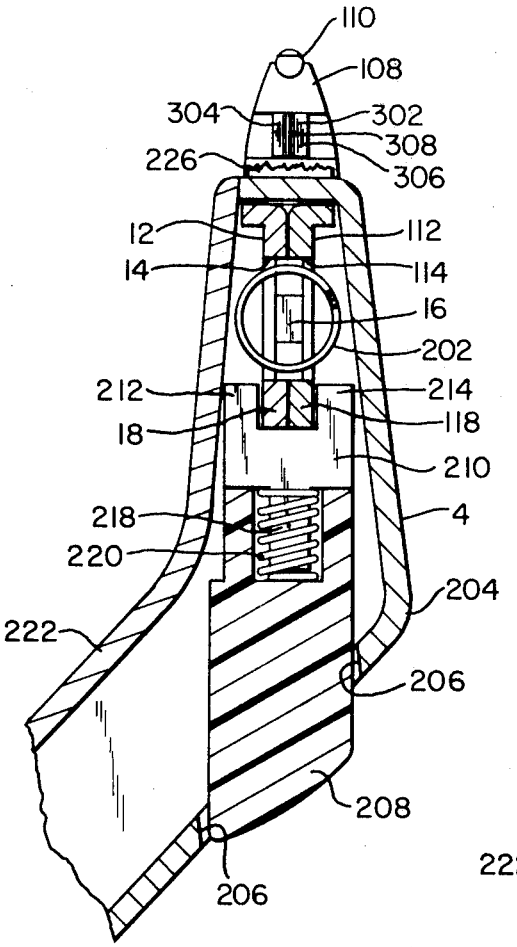
FIG. 5 is a sectional view of the handle taken along line V—V of FIG. 3.
Figure 4:
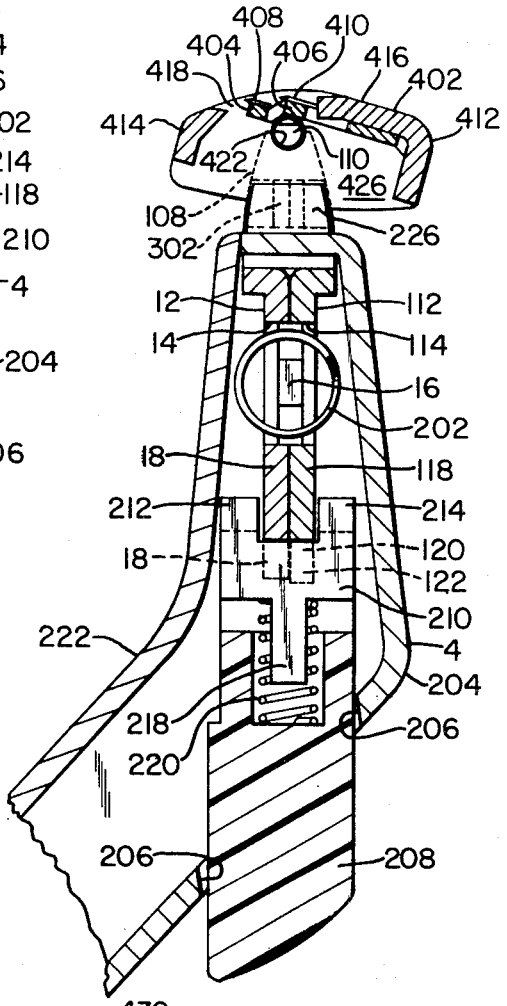
FIG. 4 is a sectional view of the handle and blade assembly taken along line IV—IV of FIG. 2.

Referring again to the drawings, it will be seen that the first and second arm portions 6, 106 are each provided with cam means 300, 302 thereon, the cam means being engageable with complementary cam means on the blade assembly (further described below). The cam means 300, 302 cooperate with the blade assembly cam means to urge the pivotally mounted blade assembly toward a neutral position. In the illustrative example, the cam means 300, 302 each comprise an inwardly-extending protrusion formed integrally with the upstanding end portion 8, 108 of either arm 6, 106. Each cam includes a pair of cam surfaces 304, 306 (FIG. 5) intersecting at an apex 308.

Figure 3:
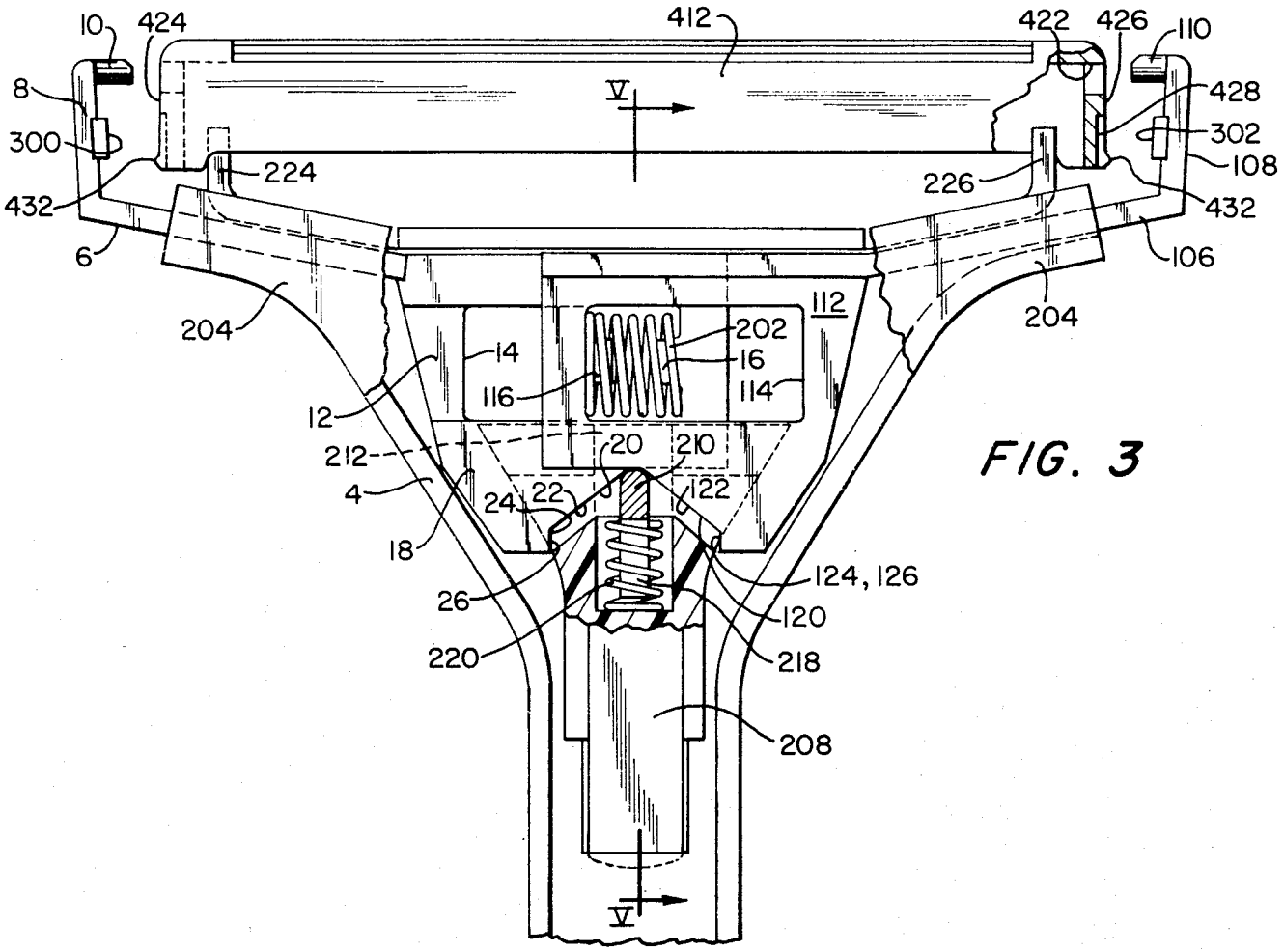
FIG. 3 is similar to FIG. 2, but showing the arms in the blade assembly release position.
Figure 6:
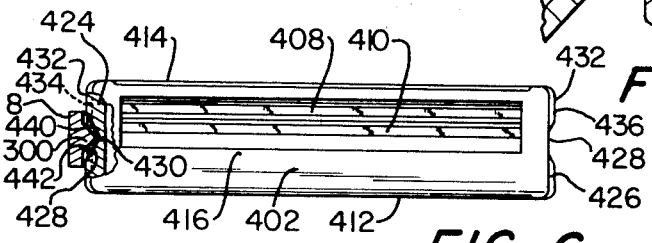
FIG. 6 is a top plan, view partly broken away, of the blade assembly adapted for use with the illustrative handle.

The blade assembly includes complementary pivot mounting means, preferably a pair of journal bearings 420, 422 (FIGS. 2 and 3) formed in the assembly. In the illustrated embodiment, the journal bearings 420, 422 are disposed in end walls 424, 426, respectively, of the housing 412. On each of the end walls, 424, 426, proximate the pertinent journal bearings, there is disposed a recess 428. Referring particularly to FIGS. 1 and 6, it will be seen that the recess 428 broadens outwardly from its inwardmost point 430, as viewed in FIG. 6. Each end wall 424, 426 of the housing is provided with a ridge 432. The recess 428 extends through the ridge 432. The edges of the recess 428 converge as the recess extends downwardly from the ridge to the base 434 of the housing end wall 424, 426. Referring to FIG. 6, it will be seen that the recess 428 is deepest in the area of the ridge 432 and tapers toward the outer surface of the end wall 424, 426. The taper of the recess toward the crest 436 of the ridge 432 defines cam surfaces 440, 442 adapted to receive the above described cam members 300, 302 disposed on the first and second arm portions of the razor to which the blade assembly is connected. The journal bearings 420, 422 are adapted to accept the journal members 10, 110 disposed on the aforementioned first and second razor arm portions, thereby to facilitate pivotal movement of the blade assembly on the razor during a shaving operation.

In connection of the blade assembly to a razor, the journal bearings 420, 422 receive the journals 10, 110 on the razor and the recesses 428 receive the cam members 300, 302 on the razor. Each cam member engages the deepest portion of its respective recess. During a shaving operation, pivotal movement of the blade assembly about an axis extending through the bearings 420, 422 causes movement of the recess, such as to bring one or the other of the cam surfaces 440, 442 to bear against the complemental surfaces of the cam members. The cam members seek the deepest portion of the recesses and thereby urge the return of the blade unit to its "neutral" position.

It is to be understood that the present invention is by no means limited to the particular construction herein disclosed and/or shown in the drawings, but also comprises any modifications or equivalents within the scope of the disclosure.

Having thus described my invention, what I claim as new and desire to secure by Letters Patent of the United States is:

1. A shaving system comprising a razor handle and a replaceable blade assembly, said handle comprising a grip portion and a head portion, said head portion having first and second arms extending therefrom, first and second pivot mounting means disposed respectively on said first and second arms, said pivot mounting means defining a pivot axis transverse to said grip portion, button means disposed on said head portion, and means interconnecting said button means and said arms whereby manual manipulation of said button means is operative to move said arms apart from each other in such manner as to cause said pivot mounting means to move away from each other along said axis, spring means biasing said arms toward each other, and cam means disposed on each of said arms, said cam means extending inwardly of said arms toward each other, and a blade assembly comprising a housing, blade means fixed to said housing, first and second pivot mounting means disposed in said housing for receiving respectively said first and second pivot mounting means of said arms for pivotal mounting of said blade assembly on said handle, and cam means disposed in said housing for complemental engagement with said handle cam means, said blade assembly cam means and said handle cam means cooperating to urge said blade assembly to a neutral position.

2. The invention in accordance with claim 1 in which said blade assembly pivot mounting means are disposed in end walls of said blade assembly.

3. The invention in accordance with claim 2 in which said blade assembly cam means are disposed in said end walls of said blade assembly.

4. The invention in accordance with claim 1 including detents upstanding from said head portion and adapted to be engaged by said blade assembly upon endwise movement of said blade assembly to prevent said endwise movement.

5. The invention in accordance with claim 1 in which said blade assembly pivot mounting means and said blade assembly cam means are integral with said blade assembly.

6. The invention in accordance with claim 1 or 5 in which said razor handle cam means are integral with said arms.

7. The invention in accordance with claim 1 in which said first and second pivot mounting means disposed respectively on said first and second arms comprise journals extending inwardly toward each other and in axial alignment with each other along said pivot axis.

8. The invention in accordance with claim 7 in which said housing pivot mounting means comprise journal bearings adapted to receive said journals.

* * * * *